US008715376B2

(12) United States Patent
Paggi et al.

(10) Patent No.: US 8,715,376 B2
(45) Date of Patent: May 6, 2014

(54) FUEL COMPOSITION AND ITS USE

(75) Inventors: Raymond Edward Paggi, Winchester, VA (US); Joseph Michael Russo, Katy, TX (US); Timothy Michael Shea, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 155 days.

(21) Appl. No.: 12/757,452

(22) Filed: Apr. 9, 2010

(65) Prior Publication Data

US 2010/0258071 A1 Oct. 14, 2010

Related U.S. Application Data

(60) Provisional application No. 61/167,924, filed on Apr. 9, 2009.

(51) Int. Cl.
*C10L 1/18* (2006.01)
*C10L 1/22* (2006.01)

(52) U.S. Cl.
USPC ..... 44/427

(58) Field of Classification Search
USPC ..... 44/427
See application file for complete search history.

(56) References Cited

U.S. PATENT DOCUMENTS

| | | | | |
|---|---|---|---|---|
| 2,120,244 | A | 6/1938 | Dryer | |
| 2,163,640 | A | 6/1939 | Bramer et al. | |
| 2,622,971 | A * | 12/1952 | Denison, Jr. | 44/428 |
| 2,643,942 | A | 6/1953 | Barusch | |
| 2,712,497 | A | 7/1955 | Fox et al. | |
| 5,123,932 | A | 6/1992 | Rath et al. | |
| 5,352,251 | A | 10/1994 | Lin et al. | |
| 5,458,660 | A | 10/1995 | Lin et al. | |
| 5,458,661 | A | 10/1995 | Lin et al. | |
| 5,493,546 | A | 2/1996 | Lin et al. | |
| 5,507,843 | A | 4/1996 | Lin et al. | |
| 5,507,844 | A | 4/1996 | Lin et al. | |
| 5,536,280 | A | 7/1996 | De Rosa et al. | |
| 5,837,016 | A | 11/1998 | Ishida et al. | |
| 5,837,867 | A | 11/1998 | Lin et al. | |
| 5,855,630 | A | 1/1999 | Lin et al. | |
| 5,928,393 | A | 7/1999 | Ishida et al. | |
| 6,261,327 | B1 | 7/2001 | Graham et al. | |
| 6,312,481 | B1 | 11/2001 | Lin et al. | |
| 7,976,591 | B2 * | 7/2011 | Paggi et al. | 44/428 |

FOREIGN PATENT DOCUMENTS

| | | | | |
|---|---|---|---|---|
| EP | 505801 | | 7/1992 | |
| EP | 0505801 | | 9/1992 | C10L 1/02 |
| EP | 505801 | * | 9/1992 | |

(Continued)

OTHER PUBLICATIONS

Database WPI Section Ch, Week 199324 Thomson Scientific, London, GB; AN 1993-191792, XP002592696 "Gasoline composition containing norbornene compound, e.g. dicyclopentadiene—has high octane number and calorific value without increase of aromatic content" & JP05117670 A (Nippon Oil KK) May 14, 1993 abstract.

(Continued)

*Primary Examiner* — Cephia D Toomer

(57) ABSTRACT

A fuel composition is provided that contains a major amount of a mixture of hydrocarbons in the gasoline boiling range and a minor amount of at least one p-alkoxy-N-alkyl aromatic amine and at least one dicyclopentadiene. Use of such additive compound in a combustion engine is also provided.

22 Claims, 1 Drawing Sheet

(56) References Cited

FOREIGN PATENT DOCUMENTS

| | | | | |
|---|---|---|---|---|
| EP | 525157 | | 1/1995 | |
| EP | 624639 | | 12/1998 | |
| EP | 2014643 | | 1/2009 | |
| GB | 350438 | | 6/1931 | |
| GB | 911491 | | 11/1962 | |
| GB | 1008593 | | 6/1963 | |
| GB | 1008593 | | 10/1965 | |
| JP | 5117670 | | 5/1993 | |
| RU | 2005138061 | | 6/2007 | |
| WO | 2005087901 | | 9/2005 | |
| WO | 2007067090 | | 6/2007 | |
| WO | WO2007067090 | * | 6/2007 | |
| WO | 2007105982 | | 9/2007 | |
| WO | 2007117176 | | 10/2007 | |
| WO | WO2007117176 | * | 10/2007 | |
| WO | 2008076759 | | 6/2008 | |
| WO | WO2008076759 | | 6/2008 | ..... C10L 1/223 |

OTHER PUBLICATIONS

International Search Report of Aug. 6, 2010.
PCT International Searching Authority Report dated Apr. 4, 2010, Application No. PCT/US2009/068465, filed Dec. 12, 2009.
PCT International Searching Authority Report dated Aug. 16, 2010, Application No. PCT/ US2010/030169, filed Apr. 7, 2010.

* cited by examiner

FUEL COMPOSITION AND ITS USE

The present application claims the benefit of U.S. Provisional Patent Application Ser. No. 61/167,924, filed Apr. 9, 2009 the entire disclosure of which is hereby incorporated by reference.

FIELD OF THE INVENTION

The present invention relates to a gasoline composition and its use, particularly, in combustion engines.

BACKGROUND OF THE INVENTION

Spark initiated internal combustion gasoline engines require fuel of a minimum octane level which depends upon the design of the engine. If such an engine is operated on a gasoline which has an octane number lower than the minimum requirement for the engine, "knocking" will occur. Generally, "knocking" occurs when a fuel, especially gasoline, spontaneously and prematurely ignites or detonates in an engine prior to spark plug initiated ignition. It may be further characterized as a non-homogeneous production of free radicals that ultimately interfere with a flame wave front. Gasolines can be refined to have sufficiently high octane numbers to run today's high compression engines, but such refining is expensive and energy intensive. To increase the octane level at decreased cost, a number of metallic fuel additives have been developed which, when added to gasoline, increase its octane rating and therefore are effective in controlling engine knock. The problem with metallic anti-knock gasoline fuel additives, however, is the high toxicity of their combustion products. For example, the thermal decomposition of polyalkyl plumbates, most notably tetramethyl and tetraethyl lead, are lead and lead oxides. All of these metallic octane improvers have been banned nationwide, because their oxidation products produce metallic lead and a variety of lead oxide salts. Lead and lead oxides are potent neurotoxins and, in the gaseous form of an automotive exhaust, become neuroactive.

Further, the improvement of combustion efficiency in gasoline engines is continuously sought. Thermal efficiency of the functional operating four stroke engine developed by Nicolaus Otto ("Otto cycle engine") is directly related to compression ratio and spark timing. The higher the compression ratio and the closer the spark timing to maximum brake torque timing, the higher the engine efficiency. Engine technology is currently limited by the availability of non-metallic octane improvers. At the refinery, significant quantities of high octane blending components are required to manufacture a high-octane fuel. In fact, limitations to the use of high concentrations of aromatics, MTBE or ETOH by regulatory mandate, increases the difficulty, the expense and the severity of refining operations to produce high octane fuels.

SUMMARY OF THE INVENTION

In accordance with certain of its aspects, in one embodiment of the present invention provides a gasoline composition comprising (a) a major amount of a mixture of hydrocarbons in the gasoline boiling range and (b) a minor amount of an additive mixture containing (i) at least one p-alkoxy-N-alkyl aromatic amine compound and (ii) at least one dicyclopentadiene.

In another embodiment, the present invention provides a method of improving the octane number of a gasoline which comprises adding to a major portion of a gasoline mixture, minor amount of an additive mixture described above.

Yet in another embodiment, the present invention provides a method for operating a spark ignition engine which comprises burning in said engine such fuel composition described above.

DETAILED DESCRIPTION OF THE INVENTION

Figure 1:
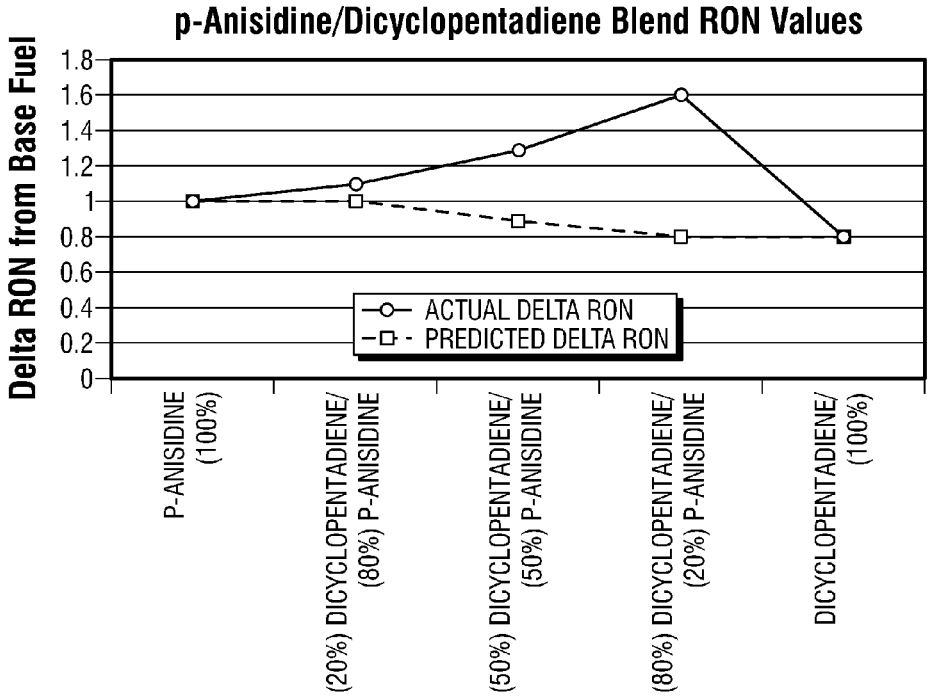
FIG. 1—This figure represent the delta Research Octane Number (RON) values between the base fuel and the predicted as well as actual RON from Examples 1-Example 3.

We have found that the blended fuel composition described above significantly enhance octane number of gasoline fuels with non-metallic compounds at much lower treat rates than typical refinery blending components. Certain mixtures of components b) i) and b) ii) have been found to provide synergistic enhancement in octane numbers. The fuel effectively increasing the auto ignition resistance of the fuel without additional refining, a significant savings is realized.

The lead-free fuel composition of the present invention comprises component b) i) at least one of certain para-anisidine. The p-alkoxy-N-alkyl aromatic amines can be compounds having the formula:

Formula I

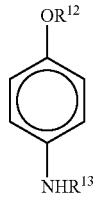

wherein $R^{13}$ and $R^{12}$ are independently hydrogen, methyl, ethyl, propyl, or butyl group with the proviso that (a) when $R^{13}$ is hydrogen, $R^{12}$ is methyl, ethyl, propyl, or butyl group and (b) when $R^{12}$ is hydrogen, $R^{13}$ is methyl, ethyl, propyl, or butyl group. The propyl and butyl group can be n-, iso-isomers.

These p-alkoxy-N-alkyl aromatic amines compounds are available from Sigma-Aldrich Inc. and Alfa Inc. Various synthetic routes can be used in the preparation of the p-alkoxy-N-alkyl aromatic amine compounds useful in the invention. For example, for p-anisidine, methoxy benzene can be slowly added with stirring to a mixture of nitric and sulfuric acid at a temperature between 0 to 5° C. The resulting mixture being predominately p-methoxy nitrobenzene is collected and reacted with hydrogen in the presence of Raney-Nickel under mild pressure between 50-110° C. The resulting p-methoxy anisidine can be collected. Other methods can be used to prepare the p-anisidine compounds useful in the invention as are known to one who is skilled in the art of organic synthesis.

P-alkoxy-N-alkyl aromatic amine compounds can be, for example, p-anisidine (p-methoxy aniline), p-methoxy anisidine, and p-aminoanisole.

The lead-free fuel composition of the present invention comprises component b) ii) dicyclopentadiene. Dicyclopentadiene can be non-substituted or substituted with an alkyl substituent. Dicyclopentadiene that are preferred includes compounds having the general formula:

Formula II

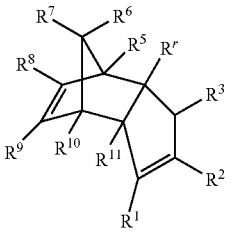

wherein $R^1$-$R^{11}$ independently is hydrogen, methyl, ethyl or propyl group with the proviso that (a) when any one of $R^1$ through $R^{11}$ is methyl the remainder of $R^1$ through $R^{11}$ be one additional methyl group with the remainder hydrogen or all hydrogen and (b) when any one of $R^1$ through $R^{11}$ is ethyl group or propyl group the remainder of $R^1$ through $R^{11}$ is hydrogen. Dicyclopentadiene is available from Sigma-Aldrich Inc and Alfa, Inc, Shell Chemical and Dow Chemical. Various synthetic routes can be used in the preparation of the dicyclopentadiene useful in the invention. For example, cyclopentadiene in a Diels-Alder reaction is slowly allowed to warm to room temperature overnight to produce white crystals which are separated to produce dicyclopentadiene. Dicyclopentadiene is also a by-product or ethylene production, via distillation of refinery pyrolysis gasoline. Other methods can be used to prepare the dicyclopentadiene compounds useful in the invention as are known to one who is skilled in the art of organic synthesis. Dicyclopentadiene is most preferred.

Component b) i) and b) ii) can be present preferably in a weight ratio range of 1:19 to 4:3, preferably 1:9 to 6:4, more preferably 1:9 to 5:5.

Suitable liquid hydrocarbon fuels of the gasoline boiling range are mixtures of hydrocarbons having a boiling range of from about 25° C. to about 232° C. and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. The octane level, (R+M)/2, will generally be above about 85. Any conventional motor fuel base can be employed in the practice of the present invention. For example, hydrocarbons in the gasoline can be replaced by up to a substantial amount of conventional alcohols or ethers, conventionally known for use in fuels. The base fuels are desirably substantially free of water since water could impede a smooth combustion.

Normally, the hydrocarbon fuel mixtures to which the invention is applied are substantially lead-free, but may contain minor amounts of blending agents such as methanol, ethanol, ethyl tertiary butyl ether, methyl tertiary butyl ether, tert-amyl methyl ether and the like, at from about 0.1% by volume to about 15% by volume of the base fuel, although larger amounts may be utilized. The fuels can also contain conventional additives including antioxidants such as phenolics, e.g., 2,6-di-tertbutylphenol or phenylenediamines, e.g., N,N'-di-sec-butyl-p-phenylenediamine, dyes, metal deactivators, dehazers such as polyester-type ethoxylated alkylphenol-formaldehyde resins. Corrosion inhibitors, such as a polyhydric alcohol ester of a succinic acid derivative having on at least one of its alpha-carbon atoms an unsubstituted or substituted aliphatic hydrocarbon group having from 20 to 50 carbon atoms, for example, pentaerythritol diester of polyisobutylene-substituted succinic acid, the polyisobutylene group having an average molecular weight of about 950, in an amount from about 1 ppm (parts per million) by weight to about 1000 ppm by weight, may also be present.

An effective amount of one or more compounds of Formula I and Formula II are introduced into the combustion zone of the engine in a variety of ways to improve octane number and/or prevent build-up of deposits, or to accomplish the reduction of intake valve deposits or the modification of existing deposits that are related to octane requirement. As mentioned, a preferred method is to add a minor amount of one or more compounds of Formula I and Formula II to the fuel. For example, one or more compounds of Formula I and Formula II may be added directly to the fuel or blended with one or more carriers and/or one or more additional detergents to form an additive concentrate, which may then be added at a later date to the fuel.

The amount of dicyclopentadiene and p-alkoxy-N-alkyl aromatic amine used will depend on the particular variation of Formula I and Formula II used, the engine, the fuel, and the presence or absence of carriers and additional detergents. Generally, each compound of Formula I is added in an amount up to about 5% by weight, especially from about 4% by weight, more preferably from about 3% by weight, even more preferably from about 2% by weight, to about 1% by weight, more preferably to about 0.5% by weight, even more preferably to about 0.4% by weight based on the total weight of the fuel composition. Generally, each compound of Formula II is added in an amount up to about 5% by weight, especially from about 4% by weight, more preferably from about 3% by weight, even more preferably from about 2% by weight, to about 1% by weight, more preferably to about 1% by weight, even more preferably to about 0.1% by weight based on the total weight of the fuel composition. The total amount of Formula I and Formula II are present in an amount up to about 5% by weight, especially from about 4% by weight, more preferably from about 3% by weight, even more preferably from about 2% by weight, to about 1% by weight, more preferably to about 0.75% by weight, even more preferably to about 0.5% by weight based on the total weight of the fuel composition.

The fuel compositions of the present invention may also contain one or more additional detergents. When additional detergents are utilized, the fuel composition will comprise a mixture of a major amount of hydrocarbons in the gasoline boiling range as described hereinbefore, a minor amount of one or more compounds of Formula I and Formula II as described hereinbefore and a minor amount of one or more additional detergents. As noted above, a carrier as described hereinbefore may also be included. As used herein, the term "minor amount" means less than about 10% by weight of the total fuel composition, preferably less than about 1% by weight of the total fuel composition and more preferably less than about 0.1% by weight of the total fuel composition. However, the term "minor amount" will contain at least some amount, preferably at least 0.001%, more preferably at least 0.01% by weight of the total fuel composition.

The one or more additional detergents are added directly to the hydrocarbons, blended with one or more carriers, blended with one or more compounds of Formula I and/or Formula II, or blended with one or more compounds of Formula I and/or Formula II and one or more carriers before being added to the hydrocarbon. The compounds of Formula I and Formula II can be added at the refinery, at a terminal, at retail, or by the consumer.

The treat rate of the fuel additive detergent packages that contains one or more additional detergents in the final fuel composition is generally in the range of from about 0.007 weight percent to about 0.76 weight percent based on the final fuel composition. The fuel additive detergent package may contain one or more detergents, dehazer, corrosion inhibitor and solvent. In addition a carrier fluidizer may sometimes be added to help in preventing intake valve sticking at low temperature.

Intake valve deposits in an internal combustion engine may be reduced by burning in such engine a fuel composition comprising: (a) a major amount of a mixture of hydrocarbons in the gasoline boiling range and (b) a minor amount of an additive compound having the formula I and Formula II.

While the invention is susceptible to various modifications and alternative forms, specific embodiments thereof are shown by way of examples herein described in detail. It should be understood, that the detailed description thereto are not intended to limit the invention to the particular form disclosed, but on the contrary, the intention is to cover all modifications, equivalents and alternatives falling within the spirit and scope of the present invention as defined by the appended claims. The present invention will be illustrated by the following illustrative embodiment, which is provided for illustration only and is not to be construed as limiting the claimed invention in any way.

Octane Test Methods

The Research Octane Number (RON) (ASTM D2699) and Motor Octane Number (MON) (ASTM D2700) will be the techniques used in determining the R+M/2 octane improvement of the fuel. The RON and MON of a spark-ignition engine fuel is determined using a standard test engine and operating conditions to compare its knock characteristic with those of primary reference fuel blends of known octane number. Compression ratio and fuel-air ratio are adjusted to produce standard knock intensity for the sample fuel, as measured by a specific electronic detonation meter instrument system. A standard knock intensity guide table relates engine compression ratio to octane number level for this specific method. The specific procedure for the RON can be found in ASTM D-2699 and the MON can be found in ASTM D-2700. Table I contains the engine conditions necessary in determine the RON and MON of a fuel.

TABLE I

RON and MON Test Conditions

| | Test Engine Conditions | |
|---|---|---|
| | Research Octane Number | Motor Octane Number |
| Test Method | ASTM D-2699-92 | ASTM D-2700-92 |
| Engine | Cooperative Fuels Research (CFR) Engine | Cooperative Fuels Research (CFR) Engine |
| Engine RPM | 600 RPM | 900 RPM |
| Intake Air Temperature | Varies with Barometric Pressure (eq 88 kPA = 19.4° C., 101.6 kPa = 52.2° C.) | 38° C. |
| Intake Air Humidity | 3.56-7.12 g $H_2O$/kg dry air | 3.56-7.12 g $H_2O$/kg dry air |
| Intake mixture temperature | not specified | 149° C. |
| Coolant Temperature | 100° C. | 100° C. |
| Oil Temperature | 57° C. | 57° C. |
| Ignition Advance-fixed | 13 degrees BTDC | Varies with compression ratio (eq 14-26 degrees BTDC) |
| Carburetor Venture | Set according to engine altitude (eq 0-500 m = 14.3, 500-1000 m = 15.1 mm) | 14.3 mm |

Base Fuel

The base fuel used in the test was an 87 R+M/2 regular base fuel. The base fuel physical properties can be found in Table II.

TABLE II

Base Fuel Physical Properties

| | |
|---|---|
| API Gravity | 61.9 |
| RVP | 13.45 |
| Distillation, (° F.) | |
| IBP | 87.1 |
| 10% | 107.3 |
| 20% | 123.2 |
| 30% | 141.0 |
| 40% | 161.5 |
| 50% | 185.9 |
| 60% | 218.1 |
| 70% | 260.2 |
| 80% | 308.6 |
| 90% | 349.0 |
| 95% | 379.3 |
| End Pt. | 434.7 |
| % Recovered | 97.2 |
| % Residue | 1.1 |
| % Loss | 1.7 |
| FIA (vol %) | |
| Aromatic | 28 |
| Olefins | 12.7 |
| Saturates | 59.3 |
| Gum (mg/100 ml) | |
| Unwashed | 3 |
| MON | 81.9 |
| RON | 92 |
| R + M/2 | 87 |
| Oxygenates | None |

Examples 1-3 and Comparative Examples 1-2

The anti-oxidants were each added to a gallon of 87 Octane base fuel at 0.5 wt % (14.25 grams), according to Table III. The individual additives were submitted for RON and MON testing in triplicate. Graph in figure details the average (R+M/2) octane improvement from the examples.

TABLE III

| Example # | Additive (in weight %) | Additive Amount (wt %) |
|---|---|---|
| Comparative 1 | p-anisidine | 0.5 |
| Comparative 2 | Dicyclopentadiene | 0.5 |
| 1 | 80% p-anisidine<br>20% dicyclopentadiene | 0.5 |
| 2 | 50% p-anisidine<br>50% dicyclopentadiene | 0.5 |
| 3 | 20% p-anisidine<br>80% dicyclopentadiene | 0.5 |

Figure detail results of several anti-knock additives at various treat rates and their overall octane improvement to an 87 octane base fuel. The average RON anti-knock results are shown in FIG. 1. The average MON anti-knock results are shown in FIG. 1. As seen in the figures, dicyclopentadiene and p-anisidine blends have synergistic behavior over dicyclopentadiene or p-anisidine alone.

Figure 2:
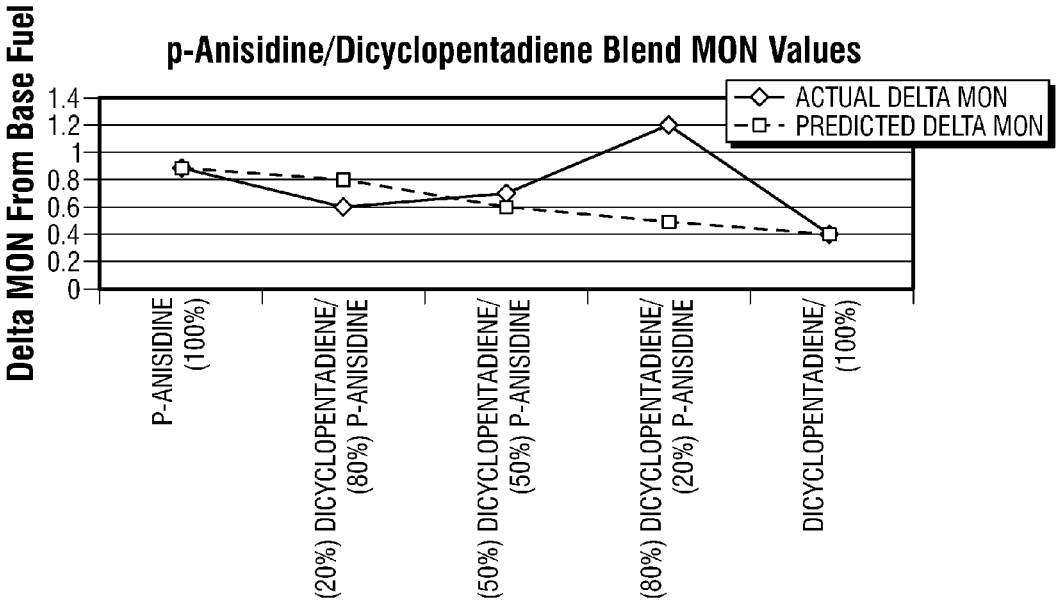
FIG. 2—This figure represent the delta Motor Octane Number (MON) values between the base fuel and the predicted as well as actual MON from Examples 1-Example 3.

More specifically, FIG. 1 represent the delta Research Octane Number (RON) values between the base fuel and the predicted as well as actual RON from Examples 1-Example 3. It can be seen and unexpected benefit is achieved via the combination of dicyclopentadiene and p-anisidine (p-methoxy aniline). FIG. 2 represent the delta Motor Octane Number (MON) values between the base fuel and the predicted as well as actual MON from Examples 1-Example 3. It can be seen and unexpected benefit is achieved via the combination of dicyclopentadiene and p-anisidine (p-methoxy aniline).

We claim:

1. A lead free fuel composition comprising:

(a) a major amount of a mixture of hydrocarbons in the gasoline boiling range, and (b) a minor amount of an additive mixture comprising:

(i) at least one compound having the following formula:

Formula I

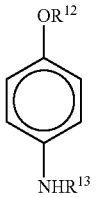

wherein $R^{13}$ and $R^{12}$ are independently hydrogen, methyl, ethyl, propyl, or butyl group with the proviso that (a) when $R^{13}$ is hydrogen, $R^{12}$ is methyl, ethyl, propyl, or butyl group and (b) when $R^{12}$ is hydrogen, $R^{13}$ is methyl, ethyl, propyl, or butyl group; and (ii) at least one dicyclopentadiene;

wherein components (b)(i) and (b)(ii) are present in the additive mixture in a ratio in the range of from about 1:19 to about 4:3.

2. The fuel composition of claim 1 wherein said additive mixture is present in an amount from about 0.01% by weight to 5% by weight, based on the total weight of the fuel.

3. The fuel composition of claim 1 wherein components (b)(i) and (b)(ii) are present in the additive mixture in a ratio in the range of from 1:9 to 6:4.

4. The fuel composition of claim 1 wherein $R^{13}$ is a methyl group.

5. The fuel composition of claim 4 wherein $R^{12}$ is selected from the group consisting of a methyl group and a butyl group.

6. A method of improving the octane number of a gasoline which comprises:

adding to a major portion of a gasoline mixture a minor amount of an additive mixture comprising:

(i) one or more p-alkoxy-N-alkyl aromatic amine compound having the following formula:

Formula I

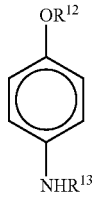

wherein $R^{13}$ and $R^{12}$ are independently hydrogen, methyl, ethyl, propyl, or butyl group with the proviso that (a) when $R^{13}$ is hydrogen, $R^{12}$ is methyl, ethyl, propyl, or butyl group and (b) when $R^{12}$ is hydrogen, $R^{13}$ is methyl, ethyl, propyl, or butyl group; and, (ii) at least one dicyclopentadiene;

wherein the components (b)(i) and (b)(ii) are present in the additive mixture in a ratio in the range of from about 1:19 to about 4:3.

7. The method of claim 6 wherein said p-alkoxy-N-alkyl aromatic amine compound and dicyclopentadiene are present in an amount from about 0.01% by weight to 5% by weight, based on the total weight of the gasoline.

8. A method for reducing intake valve deposits in an internal combustion engine which comprises burning in said engine a fuel composition of claim 1.

9. A method for reducing intake valve deposits in an internal combustion engine which comprises burning in said engine a fuel composition of claim 3.

10. A lead free fuel composition comprising:

(a) a major amount of a mixture of hydrocarbons in the gasoline boiling range; and (b) a minor amount of an additive mixture comprising:

(i) at least one compound having the following formula:

Formula I

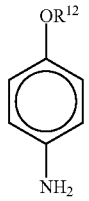

wherein $R^{12}$ is selected from the group consisting of a methyl group and a butyl group; and, (ii) at least one dicyclopentadiene;

wherein components (b)(i) and (b)(ii) are present in the additive mixture in a ratio in the range of from about 1:19 to about 4:3.

11. The fuel composition of claim 10 wherein said additive mixture is present in an amount from about 0.01% by weight to 5% by weight based on the total weight of the fuel.

12. The fuel composition of claim 10 wherein components (b)(i) and (b)(ii) are present in the additive mixture in a ratio in the range of from 1:9 to 6:4.

13. The fuel composition of claim 11 wherein components (b)(i) and (b)(ii) are present in the additive mixture in a ratio in the range of from 1:9 to 6:4.

14. The fuel composition of claim 11 wherein, based on the total weight of the additive, component (b)(i) is present at about 20 wt. % and component (b)(ii) is present at about 80 wt. %.

15. A method for reducing intake valve deposits in an internal combustion engine which comprises burning in said engine a fuel composition of claim 10.

16. A method of improving the octane number of a gasoline, the method comprising:

mixing (a) a major portion of a gasoline mixture, with (b) minor amounts of an additive mixture comprising:

(i) a p-alkoxy-N-alkyl aromatic amine compound having the following formula:

Formula I

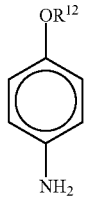

wherein $R^{12}$ is selected from the group consisting of a methyl group and a butyl group; and, (ii) at least one dicyclopentadiene;

wherein components (b)(i) and (b)(ii) are present in the additive mixture in a ratio in the range of from about 1:19 to about 4:3.

17. The method of claim 16 wherein said additive mixture is present in an amount from about 0.01% by weight to 5% by weight base on the total weight of the fuel.

18. The method of claim 16 wherein components (b)(i) and (b)(ii) are present in the additive mixture in a ratio in the range of from 1:9 to 6:4.

19. The method of claim 17 wherein components (b)(i) and (b)(ii) are present in the additive mixture in a ratio in the range of from 1:9 to 6:4.

20. The method of claim 16 wherein, based on the total weight of the additive, component (b)(i) is present at about 20 wt. % and component (b)(ii) is present at about 80 wt. %.

21. The method of claim 1 wherein, based on the total weight of the additive, component (b)(i) is present at about 20 wt. % and component (b)(ii) is present at about 80 wt. %.

22. The method of claim 2 where, based on the total weight of the additive, component (b)(i) is present at about 20 wt. % and component (b)(ii) is present at about 80 wt. %.

* * * * *